United States Patent [19]

Meyer

[11] 4,180,995

[45] Jan. 1, 1980

[54] PRESSING APPARATUS FOR SQUEEZING LAUNDRY AND THE LIKE

[76] Inventor: Arnfried Meyer, Würzburger Strasse, 7100 Heilbronn, Fed. Rep. of Germany

[21] Appl. No.: 860,094

[22] Filed: Dec. 13, 1977

[30] Foreign Application Priority Data

Dec. 13, 1976 [AT] Austria ..... 9194/76

[51] Int. Cl.[2] ..... D06F 47/06

[52] U.S. Cl. ..... 68/242; 100/116; 100/211

[58] Field of Search ..... 68/21, 96, 242; 100/211, 116

[56] References Cited

U.S. PATENT DOCUMENTS

| | | | |
|---|---|---|---|
| 3,908,413 | 9/1975 | Meyer | 68/242 |
| 3,924,425 | 12/1975 | Arendt | 68/242 |

FOREIGN PATENT DOCUMENTS

| | | | |
|---|---|---|---|
| 236173 | 11/1961 | Australia | 100/211 |
| 1485090 | 5/1969 | Fed. Rep. of Germany | 68/242 |
| 2602845 | 7/1976 | Fed. Rep. of Germany | 68/21 |

*Primary Examiner*—Philip R. Coe

*Attorney, Agent, or Firm*—Craig and Antonelli

[57] ABSTRACT

A press for squeezing out batch material, especially laundry, with an elastic pressure member which can be charged with a pressure medium, in a housing, and a conveyor belt for conveying the batch material from a loading station to a pressing station below the said pressure member, and to a discharge station after the squeezing is disclosed.

16 Claims, 6 Drawing Figures

PRESSING APPARATUS FOR SQUEEZING LAUNDRY AND THE LIKE

BACKGROUND AND SUMMARY OF THE INVENTION

The invention relates to a press for squeezing out batch material, especially laundry, with an elastic pressure member which can be charged with a pressure medium, in a housing, and a conveyor belt for conveying the batch material from a loading station to a pressing station below the said pressure member, and to a discharge station after the squeezing.

From German OS No. 2,440,818 a pressing facility is already known, for squeezing out liquid, in which a metallic bell that can be raised and lowered is provided with an elastic membrane which covers the lower opening, serving as a pressure member. To press, this bell is lowered over the batch material lying on the conveyor belt. Then the bell is mechanically locked by pawls to the support below it which receives the downwardly directed pressure. Only thereafter, by introduction of a pressure medium between the bell and the membrane, is the said membrane pressed against the batch material and the liquid in it is squeezed out. After completion of the pressing phase, the pressure medium is pumped out, the bell and the support are unlocked by outward lateral movement of the pawls, and the bell is raised, whereafter the batch material is carried by the conveyor belt to the unloading station. To execute the pressing phase therefore, a number of ancillary machines are needed, entailing considerable outlay for setting and control means. The individual kinds of motion take time, moreover, which disadvantageously lengthens the pressing phase time. Moreover, the bell, the support and the pawls have to be manufactured as separate parts, and they have to be rigid to accept the great pressure. They are therefore heavy components which have to be moved by correspondingly big setting means. Finally, for control of precise assumption of the many end positions, control means must be provided whereby signals can be transmitted to the controls, to ensure a distinct sequence of functions. The known press therefore is cumbersome in its structure and complex in its operation.

The invention therefore has as an object to simplify the device for squeezing out batch material, both in construction and in control.

This problem is solved by the invention according to a preferred embodiment in that a more or less tubular housing is provided in which a pressure member is disposed about in the region of one inner peripheral half, and in the other half there is a pressure bearing member.

An especially advantageous embodiment of the press results in a further development of the invention, in that the pressure bearing member is made as a support for the water-permeable conveyor belt which is taken through the housing, and in that below the conveyor belt there are conduits in the pressure bearing member, for discharge of expressed water.

According to another characteristic of the invention, the pressure member is made as a flat elastic membrane that is fixed with a sealing lip, by means of a retaining device, tightly on the inner wall of the housing.

A simple arrangement of the pressure member is produced according to a further characteristic of the invention, in that the pressure member, in the mid-longitudinal zone of the housing, is parallel to and close to the bearing member, and in that at both housing ends it is fixed to the inner wall of the housing by upwardly slanting, outwardly bent end faces.

Another characteristic of the invention is that the housing, at both ends, presents slides to close the opening, which slides are guided more or less parallel to the end faces of the pressure member, in housing slits.

According to still another aspect of the invention, the pressure member can be made as an elastic hose, closed at both ends, and disposed in the housing.

Advantages offered by the invention consist particularly in that the housing in itself constitutes a closed unit which is especially suited by its tubular configuration for acceptance of high tensile stresses. By the disposition of the pressure member and the pressure bearing member in opposition to each other, there is a favorable seat for the batch material that is to be squeezed, which additionally can be simply fed in and carried off again after the squeezing process. As a consequence of the arrangement according to the invention, the press is almost independent of its position of incorporation, i.e., it does not absolutely have to be disposed with a horizontal axis. Because of the arrangement of the pressure member in one of the peripheral halves of the housing, the compression forces that occur are substantially absorbed internally. For this reason there is elimination of all connecting means to join housing parts, e.g., pawls, and their setting, guiding and controlling means. This is a considerable simplification of a press for squeezing batch material, both in construction and operation. Moreover, it has a high functional reliability, with little outlay for servicing.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
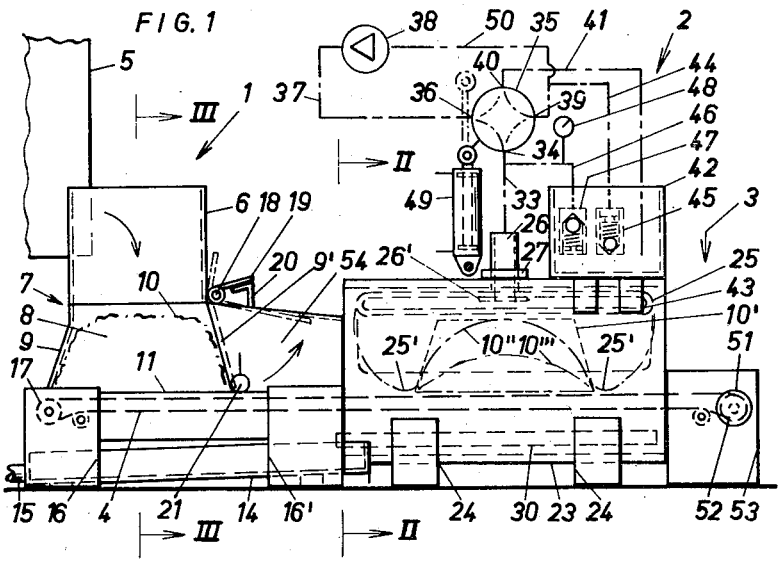
FIG. 1 is a lateral view of the press.

The device for pressing batch material, especially laundry, consists of a loading station 1, a pressing station 2, and an unloading station 3. These stations 1–3 are connected by a conveyor belt 4, advantageously made water-permeable by perforation. Upstream of loading station 1 there is a washing machine 5 from whose drum the batch material is periodically unloaded. The material falls into a hopper 6 which opens below into a shaping box 7 with vertical side walls 8 and end faces 9 and 9' that are spread outward toward the bottom, said box 7 being disposed above conveyor belt 4. The batch material 10 that has fallen into shaping box 7 is thereby shaped somewhat prismatically. Hopper 6 with box 7 is in contact with a belt guide 11 which supports the forward and backward running strands of conveyor belt 4, and which is made water-permeable by perforations 12.

The inwardly directed deflecting walls 13 on the lower end lead the downwardly issuing water into a slanted trough 14 lying below them, said trough having at its lower end face a discharge pipe 15. Belt guide 11 and trough 14 are supported by posts 16 and 16' whereby post 16 at the side toward the end likewise serves as bearing for a deflector roll 17 for conveyor belt 4.

End face 9' of shaping box 7, which is in the direction of transport of batch material 10, is hingedly borne about a shaft 18 disposed at the upper end. In the illustrated closed position according to FIG. 1, a bent extension 19 of the upper end is applied to a stationary stop 20. In the transport direction on either side of the lower end of end face 9', there extend adjustable locks 22 that are moved for example by motors 21, e.g., pneumatic cylinders, the said locks locking end face 9' in the closed position against swing, in the counterclockwise direction.

Following loading station 1, there is pressing station 2 with a tubular housing 23 borne on braces 24. In this housing 23 which is advantageously made as an undivided tube, about in the region of the upper peripheral half and extending over practically the entire length, there is disposed a pressure member 25. This is a flat hose, closed at both ends, connected by a conduit 26 with a pressure medium source so as to receive a pressure medium. Conduit 26 presents a bearing plate 26' in pressure member 25, and is detachably bolted to housing 23 by a nut 27. This bolt connection is the only retaining means for pressure member 25 with respect to housing 23. Below pressure member 25, advantageously somewhat below the horizontal diameter in housing 23, there is disposed a bearing member 28, e.g., of concrete or metal, which has a flat upper surface, bearing on the interior of housing 23, on which the lower strand of conveyor belt 4 slides. In bearing member 28 there are vertical and horizontal as well as transverse connecting passages 29 starting from the upper surface, that connect with conduits 30 which run in the longitudinal direction of housing 23. Between the upper and lower strands of conveyor belt 4 there is a plate 31 which is liquid-permeable because of perforation. The liquid from the batch material 10 can thus pass through permeable conveyor belt 4, plate 31 and connecting passages 29 into conduits 30. Conveyor belt 4 and plate 31 are superimposed in such a way that in the pressing phase there is direct contact in the direction of compression, whereby permeability to liquid is always maintained. In the transport phase on the contrary, the mobility of belt 4 is ensured so that the batch material lying on it can move. Between the lower edges of pressure member 25 and bearing member 28 there are wedge-shaped transition members 32, to ensure smooth transition at the edges.

For impinging of the pressure medium, according to the system shown schematically in FIG. 1, pressure medium conduit 26 is connected via a pipe 33 with connection 34 of a four-way valve 35. In the illustrated filling setting of four-way valve 35, connection 34 is joined with connection 36, which is connected via a pressure line 37 with the pressure side of a motor driven pump 38. A suction line 50 connects the suction side of pump 38 with connection 39 of four-way valve 35, which in the illustrated filling position is connected with connection 40. From the latter there leads a line 41, into an advantageously water-filled reservoir 42 which is seated on bearing blocks 43 on housing 23. A safety line 44 ending in reservoir 42 is also connected to suction line 50, said safety line 44 having an adjustable check valve 45 which only allows a flow of liquid in the direction of suction line 50 after a relatively low pressure has been overcome. An excess pressure line 46, likewise ending in reservoir 42, opens into pipe 33, said line 46 having a check valve 47 that only allows a flow of liquid in the direction of reservoir 42 after a relatively high pressure has been overcome, namely the compression pressure. A manometer 48 monitors this pressure level, said manometer 48 being connected upstream of check valve 47 on excess pressure line 46. The manometer may also serve for automatic monitoring of the maximum pressure. There is a setting cylinder 49 for setting four-way valve 35. After cylinder 49 has been extended as indicated by the dot-and-dash line, it turns the clock at a right angle clockwise so that connections 36 and 40 as well as connections 34 and 39 are connected with each other.

In unloading station 3, conveyor belt 4 is deflected in the opposite direction by a deflector roll 52, borne in a post 53 and driven by motor 51.

Figure 2:
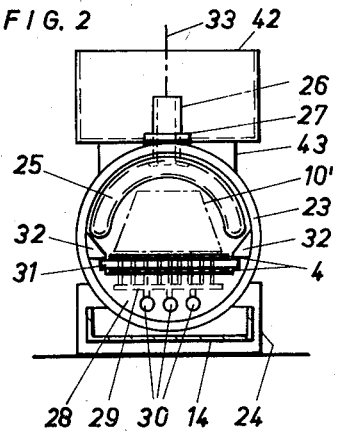
FIG. 2 is a section along line II—II of FIG. 1.
Figure 3:
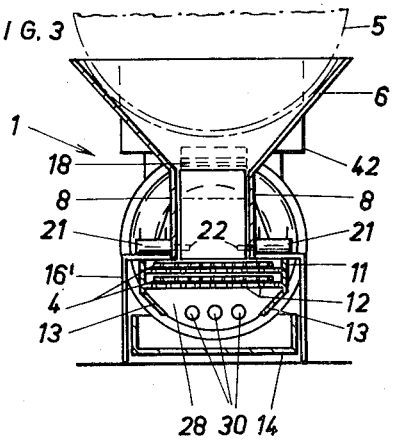
FIG. 3 is a section along line III—III of FIG. 1.

The functioning of the pressing device is such that a batch of material 10 from washing machine 5 will fall into shaping box 7 of loading station 1 and adapt itself there more or less to the configuration of box 7, whereby excess water will run downward into trough 14. As soon as the previous pressing operation has been concluded, setting motors 21 pull locks 22 from the region of the forward face 9' and conveyor belt 4 is switched on. It begins to move in the direction of pressing station 2. The moving batch material 10 presses end face 9' upward into the position indicated by dot-and-dash lines, so that now a closed transfer passage 54 is formed, whereby the rectangular cross section of batch material 10 will be deformed more or less as a trapezium, as indicated by 10' in FIG. 2, to achieve a high degree of use of the free cross section in housing 23 below pressure member 25. After passage of batch material 10 end face 9' automatically folds down again and is locked. The next batch of material 10 can be charged into shaping box 7.

Batch material 10' running into housing 23 is positioned at a location which is centered with respect to pressure member 25 by stopping the conveyor belt 4, by a monitoring device, e.g., a photocell that is not illustrated. Four-way valve 35 is then set in the filling setting shown in FIG. 1. By continuously running pump 38, water is thus pumped via line 41, connections 40 and 39 of four-way valve 35, suction line 50, and downstream of pump 38 through pressure line 37, connections 36 and 34 of four-way valve 35, pipe 33 and pressure medium conduit 26, into pressure member 25. The pressure member thereby expands downward and is applied with increasing pressure on batch material 10', so that the material more or less assumes the configuration 10'' and is finally compressed to configuration 10''' as shown in FIG. 1. At the front and rear, pressure member 25 is applied on either side of batch material 10'' on conveyor belt 4, as indicated by 25', so that batch material 10'' is now in a closed compression chamber. After the set maximum pressure is reached, the water flows through excess pressure line 46 and check valve 47, back into reservoir 42.

Figure 4:
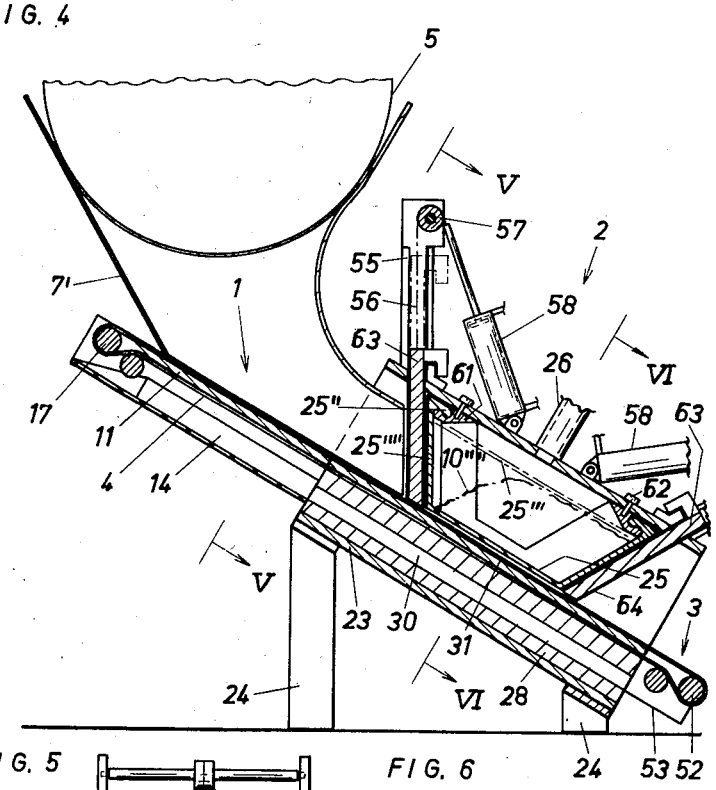
FIG. 4 is a longitudinal section, through another form of embodiment of the press.
Figure 5:
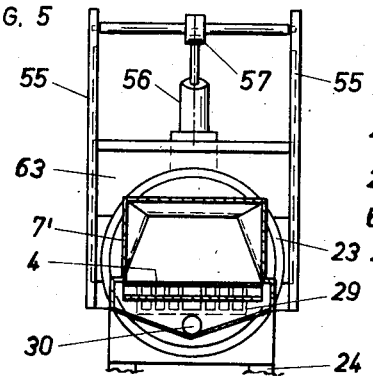
FIG. 5 is a section along line V—V of FIG. 4.
Figure 6:
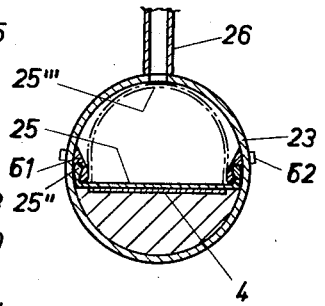
FIG. 6 is a section along line VI—VI of FIG. 4.

In a further embodiment of the invention according to FIGS. 4 to 6, pressure member 25 is made as a flat relatively thin elastic membrane, of rubber or the like, which is held tightly with a sealing lip 25'' in an annular closed retaining device 61 on the inner wall of housing 23 as shown in FIG. 4. This retaining device 61 is fixed inside housing 23 with screws 62, so that pressure member 25 can be readily exchanged. Pressure member 25, moreover, is disposed in the mid-zone of housing 23 parallel to and close above bearing member 28 and the conveyor belt 4 respectively, with upwardly slanted faces 25'''' at the two ends of the housing. To close the two openings of tubular housing 23, there are slides 63, which can dip down onto conveyor belt 4 about parallel to end faces 25'''' of pressure member 25 in slits 64 in housing 23.

For further guiding of slides 63, there are guides 55 on either side, in which slides 63 can be withdrawn upward until the openings of housing 23 are entirely free. For this there is a rope 56 laid about a roll 57 which is rotatably borne above, between guides 55, and connected to the piston rod of a hydraulic or pneumatic actuating cylinder 58. It is clear that slides 63 can be lifted from the lower position of closure by moving the piston rod into an upper open setting such as indicated by dot-and-dash lines above the position shown for leftmost slide 63 in FIG. 4.

It is also clear that by sucking out the water, pressure member 25 can be brought about into a starting position 25''' inside housing 23, as indicated in FIG. 4. Additionally, and as also shown in FIG. 4, bearing housing 23, which carries the press, can be supported by the braces 24 so as to be slanted in the direction of transport, whereby between washing machine 5 and housing 23 there will be only a hopper-shaped shaping box 7'. The end of box 7' on the output side extends into housing 23 and presents cross-sectional configuration of the free cross section when pressure member 25 is in its starting position 25'''.

The batch of laundry which has fallen out of washing machine 5 then slides through shaping box 7' into housing 23 and there, with slide 53 closed on the exit side (right-hand side as seen in FIG. 4) it assumes about the position marked 10''''. The conveyor belt 4 can be stopped or run in the transport direction. By lowering slide 53 on the intake side, housing 23 will be closed and the pressing process can begin as described above, by introduction of water under pressure through pressure medium conduit 26, whereby pressure member 25, from its starting position 25''' will bear on batch material 10'''' and squeeze it out. After pressing, the water is withdrawn, pressure member 25 is returned to its starting position, the slides 53 are moved into their raised free position and the squeezed batch of material is carried away from housing 23 by switching on conveyor belt 4. After closing slide 53 on the outlet side, the next pressing operation can begin with filling of housing 23.

Of course, the batch material could simply be floated into housing 23, so that conveyor belt 4 would serve only to carry it off, and consequently the belt could be shorter. Finally, housing 23 can be made tiltable, so that it can assume a suitable position for filling and emptying. In a further embodiment, one slide 53 could constantly be closed, so that filling and emptying would occur through a single opening.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A press for squeezing out batch material, especially laundry, comprising:

an elastic pressure member that can be charged with a pressure medium, a housing, said pressure member being positioned in said housing, and a liquid-permeable conveyor belt guided through said housing to transport the batch material from a loading station outside said housing, to a pressing station below the pressure member, and after squeezing, to a discharge station outside said housing, characterized in that said housing is generally tubular, the pressure member is disposed generally in the region of only one half the inner periphery of the housing, and a bearing member is provided in the other peripheral half, and that said bearing member is made as a support for the liquid-permeable conveyor belt that is guided through the housing, and in that below the conveyor belt there are conduits in the bearing member for liquid expressed from said batch material by said pressure member.

2. A press according to claim 1, characterized in that the pressure member is made as a flat elastic membrane, which is fixed tightly at its edge to the inner wall of the housing with a sealing lip by means of a retaining device.

3. A press according to claim 2, characterized in that the pressure member, in a mid-longitudinal zone of the housing, is parallel to and near to the bearing member and at both ends of the housing is fixed to the inner wall of the housing with upwardly slanted outwardly bent end faces.

4. A press according to claim 3, characterized in that the housing has an opening at both housing ends, slide members being provided at each end to close the openings, each said slide member being guided generally parallel to end faces of the pressure member in slits in the housing.

5. A press according to claim 3, characterized in that in its emptied state, the pressure member has about the configuration of a flat hose, which is applied to about one peripheral half of the inside of the housing.

6. A press according to claim 3, characterized in that the pressure member communicates with a pressure medium conduit which is guided through the housing and serves as the sole retainer for the pressure member.

7. A press according to claim 2, characterized in that the housing has an opening at both housing ends, slide members being provided at each end to close the openings, each said slide member being guided generally parallel to end faces of the pressure member in slits in the housing.

8. A press according to claim 2, characterized in that the housing is disposed at a slant in the longitudinal direction.

9. A press according to claim 1, characterized in that the pressure member is made as an elastic hose closed at both ends.

10. A press according to claim 9, characterized in that between the pressure member and the bearing member there is a more or less wedge-shaped transition piece applied to the inside of the housing.

11. A press according to claim 1, characterized in that the pressure member communicates with a pressure medium conduit which is guided through the housing and serves as the sole retainer for the pressure member.

12. A press according to claim 1, characterized in that the conveyor belt has forward and backward running strands which are guided above the bearing member and in that between the two strands there is a plate which presents aperture means for carrying off the water.

13. A press according to claim 1, characterized in that the housing is disposed at a slant in the longitudinal direction.

14. A press for squeezing out batch material, especially laundry, comprising:

(a) a housing having an opening at at least one end thereof;

(b) a liquid-permeable conveyor belt for transporting the batch material from loading and unloading stations outside said housing to a pressing station within said housing;

(c) an elastic pressure member that can be charged with a pressure medium for expressing liquid from said batch material and disposed within substantially only an upper half of said housing so as to define a transversely generally semi-circular pressing chamber in conjunction with said conveyor belt, said pressure member having end portions displaceable under influence of said pressure medium from a position enabling passage of said batch material through said opening to a position enclosing ends of said batch material facing said at least one opening; and (d) means beneath said conveyor belt for withdrawing liquid passing therethrough.

15. A press according to claim 14, comprising slide means for closing said at least one opening, said slide means being receivable in slits formed in said housing.

16. A press according to claim 15, wherein said housing has an opening at both ends.

* * * * *